US007744254B2

(12) United States Patent
Spiro

(10) Patent No.: US 7,744,254 B2
(45) Date of Patent: Jun. 29, 2010

(54) BALLAST HOUSING FOR ELECTRONIC HID LUMINAIRE

(75) Inventor: Daniel S. Spiro, 4260 N. Brown Ave., Scottsdale, AZ (US) 85251

(73) Assignee: Daniel S. Spiro, Scottsdale, AZ (US)

( * ) Notice: Subject to any disclaimer, the term of this patent is extended or adjusted under 35 U.S.C. 154(b) by 0 days.

(21) Appl. No.: 11/892,006

(22) Filed: Aug. 17, 2007

(65) Prior Publication Data

US 2008/0061668 A1 Mar. 13, 2008

Related U.S. Application Data

(60) Provisional application No. 60/838,139, filed on Aug. 17, 2006.

(51) Int. Cl.
*F21V 7/00* (2006.01)
*F21V 19/02* (2006.01)
*F21V 23/02* (2006.01)

(52) U.S. Cl. ..... 362/297; 362/296.05; 362/285; 362/265

(58) Field of Classification Search ..... 362/296, 362/297, 285, 263, 264, 265, 276, 302, 305, 362/345, 350, 373, 362, 261, 346, 347; 315/307; 313/113

See application file for complete search history.

(56) References Cited

U.S. PATENT DOCUMENTS 1,286,535 A * 12/1918 Cochran ..... 362/302
3,113,694 A * 12/1963 Sulzer ..... 220/62
4,173,037 A * 10/1979 Henderson et al. ..... 362/287
4,414,615 A * 11/1983 Szeker et al. ..... 362/264
4,943,901 A * 7/1990 Baldwin et al. ..... 362/277
5,136,490 A * 8/1992 Morrison ..... 362/294
5,548,497 A 8/1996 Cho
5,582,479 A * 12/1996 Thomas et al. ..... 362/277
5,803,593 A * 9/1998 Siminovitch et al. ..... 362/304
5,967,646 A * 10/1999 Engel ..... 362/296
6,175,487 B1 1/2001 McCartney et al.
6,601,975 B1 8/2003 Haugaard et al.
6,698,908 B2 3/2004 Sitzema, Jr. et al.
6,713,975 B2 * 3/2004 Yamauchi et al. ..... 315/308
6,874,914 B2 * 4/2005 Desanto et al. ..... 362/372
6,882,119 B2 * 4/2005 Shields ..... 315/291
6,905,222 B1 6/2005 Russello et al.
6,910,785 B2 * 6/2005 Sales ..... 362/333
6,918,680 B2 * 7/2005 Seeberger ..... 362/150
7,025,476 B2 * 4/2006 Leadford ..... 362/309
2003/0021103 A1 1/2003 Christie
2003/0165058 A1 9/2003 Osborn, Jr.
2004/0001336 A1 1/2004 Wang et al.
2004/0240132 A1 * 12/2004 Hudson ..... 361/62
2004/0240208 A1 * 12/2004 Beasley ..... 362/276
2005/0228599 A1 * 10/2005 Culp et al. ..... 702/62

* cited by examiner

*Primary Examiner*—Jong-Suk (James) Lee
*Assistant Examiner*—David R Crowe
(74) *Attorney, Agent, or Firm*—Duane Morris LLP

(57) ABSTRACT

A luminaire having a housing containing an electronics assembly and a vertically oriented high intensity discharge lamp extending downwardly from a lamp socket carried by the housing, and a reflector carried by said housing for distributing the light emitted from the lamp. The reflector is positioned in relation to the housing and the lower portion of the housing is shaped to extend upwardly and outwardly from the lamp socket to the periphery of the housing to effectuate a convective uniform airflow upward and outward away from the electronics assembly during operation of the lamp.

22 Claims, 20 Drawing Sheets

BALLAST HOUSING FOR ELECTRONIC HID LUMINAIRE

REFERENCE TO PRIOR APPLICATIONS

The instant application claims the priority benefit of U.S. Provisional Application No. 60/838,139, filed Aug. 17, 2006, entitled "Ballast Housing for Electronic HID Luminaire," the entirety of which is incorporated herein by reference.

BACKGROUND

Luminaires typically include an optical assembly and an electrical assembly. The optical assembly contains the lamp and the refractor and/or reflector, which produces and directs light at varying degrees. The electrical assembly provides power to the lamp and has a housing which is generally formed of metal and which encloses the electrical circuitry that generally includes a ballast. The ballast is commonly utilized to provide necessary circuit conditions for starting and operating an electric-discharge lamp, such as high intensity discharge ("HID") lamps of the high pressure sodium, metal halide, or mercury type, among others.

The electrical assembly of prior art luminaires, and particularly the respective housing, can be large due to need for relatively large surface area to dissipate ballast heat. Depending upon the positioning of the electrical assembly relative to the optical assembly (i.e., above or below), the size of the housing may result in less uplight or downlight, respectively, and thus contribute to an overall less efficient lighting system.

Prior art designs have the ballast located within the housing with other components of the luminaire, including the light source. As a result the operation temperature of the ballast and the control components are increased due to exposure to the light source. The useful life of the components is reduced, and the components must be replaced more often.

Another feature of existing luminaires is that the light source is often mounted within the mounting structure. This feature has the drawback that a significant amount of the light from the light source emanates upward, thereby degrading the amount of light from the luminaire. Although reflectors may be used to deflect some of the light emanating upward, a large portion of the light from the light source may be lost.

Thus, there is a need in the art to provide for a luminaire that provides for an efficient distribution of light. There is also a need in the art to provide for air flow management in a luminaire. Improved luminaires and methods according to embodiments of the present subject matter may be used to improve the light output of a luminaire through various techniques not taught by or known in the lighting industry. Therefore, an embodiment of the present subject matter provides a luminaire for a light source. The luminaire may comprise a housing having an upper portion, a lower portion mated to the upper portion forming an internal cavity, and a central recessed portion formed in the lower portion. The housing may also possess an electronics assembly positioned within the cavity, a socket positioned within the central recessed portion. The socket may be operatively connected to the ballast and adapted to operatively and removably receive a light source. The housing may further comprise insulation positioned within the cavity intermediate the electronics assembly and socket. The luminaire may also include a reflector supported from the housing and reflector positioned to encompass a light source operatively received in the socket. The upper end of the reflector may be positioned in proximity to but spaced from the lower portion with the reflector reflecting downwardly light incident thereon emitted from a light source operating in the socket. The luminaire may comprise a reflective surface covering at least a major portion of the external surface of the lower portion. The reflective surface may surround the central recessed portion and extend outwardly and upwardly from the central recessed portion toward the periphery of the lower portion where the reflective surface possesses a shape for reflecting downwardly light incident thereon emitted from a light source operating in the socket.

Another embodiment of the present subject matter provides a luminaire for a light source comprising a housing assembly defining an internal cavity and having a lower portion extending upwardly and outwardly from a central recessed portion formed therein and an electronics assembly positioned within the cavity. The luminaire may further include a lamp socket positioned in the central recessed portion and operatively connected to the electronics assembly, the socket being adapted to operatively and removably receive a light source therein. The housing assembly may also support a reflector. The reflector may be positioned to encompass a light source operatively received in the socket with the upper end of the reflector positioned in proximity to but spaced from the lower portion such that the reflector reflects downwardly light incident thereon emitted from a light source operating in the socket.

A further embodiment of the present subject matter provides a method of dissipating heat generated from a high intensity discharge lamp carried in a luminaire having a housing containing an electronics assembly, the lamp extending downwardly from a lamp socket carried by the housing. The method may comprise the steps of shaping a lower portion of the housing to extend upwardly and outwardly from the lamp socket to the periphery of the housing to thereby effect a convective uniform airflow upward and outward away from the electronics assembly during operation of the lamp.

An additional embodiment of the present subject matter provides a method of adjusting the light distribution of a luminaire having a housing containing an electronics assembly, a vertically oriented high intensity discharge lamp extending downwardly from a lamp socket carried by the housing, and a reflector carried by said housing for distributing the light emitted from the lamp. The method comprises the step of selectively moving the vertical position of the socket relative to the reflector.

Yet another embodiment of the present subject matter provides a method of enhancing the downward distribution of light in a luminaire having a housing containing an electronics assembly, a vertically oriented high intensity discharge lamp extending downwardly from a lamp socket carried by the housing, and a reflector carried by the housing for downwardly distributing the light emitted from the lamp. The method comprises the step of providing a reflective surface extending upwardly and outwardly from the periphery of the socket to the periphery of the housing to thereby downwardly reflect incident light thereon emitted from the lamp.

One embodiment of the present subject matter provides a luminaire for a light source comprising a housing assembly defining an internal cavity and having a lower portion extending upwardly and outwardly from a central recessed portion formed therein and an electronics assembly positioned within the cavity. The electronics assembly may include a ballast and a programmable microprocessor adaptable to communicate with a controller. The luminaire may further comprise a lamp socket positioned in the central recessed portion, operatively connected to the electronics assembly, and adapted to operatively and removably receive a light source therein. The luminaire may also comprise a reflector supported from the housing assembly.

A further embodiment of the present subject matter provides a method of monitoring power usage of a luminaire having a housing containing an electronics assembly and a high intensity discharge lamp connected to a lamp socket carried by the housing. The method comprises the steps of monitoring selected operating characteristics and transmitting information related to one or more of the operating characteristics from the luminaire to a remote database.

One embodiment of the present subject matter provides a method of establishing an operational schedule of a luminaire having a housing containing an electronics assembly and a high intensity discharge lamp connected to a lamp socket carried by the housing. The method comprises the steps of transmitting information from the luminaire to a remote database and receiving operational commands at the luminaire in response to the transmitted information.

These embodiments and many other objects and advantages thereof will be readily apparent to one skilled in the art to which the invention pertains from a perusal of the claims, the appended drawings, and the following detailed description of the embodiments.

DETAILED DESCRIPTION OF THE DRAWINGS

With reference to the figures where like elements have been given like numerical designations to facilitate an understanding of the present subject matter, the various embodiments of a method and apparatus for a ballast housing for an electronic high intensity discharge ("HID") luminaire are described herein.

Figure 1:
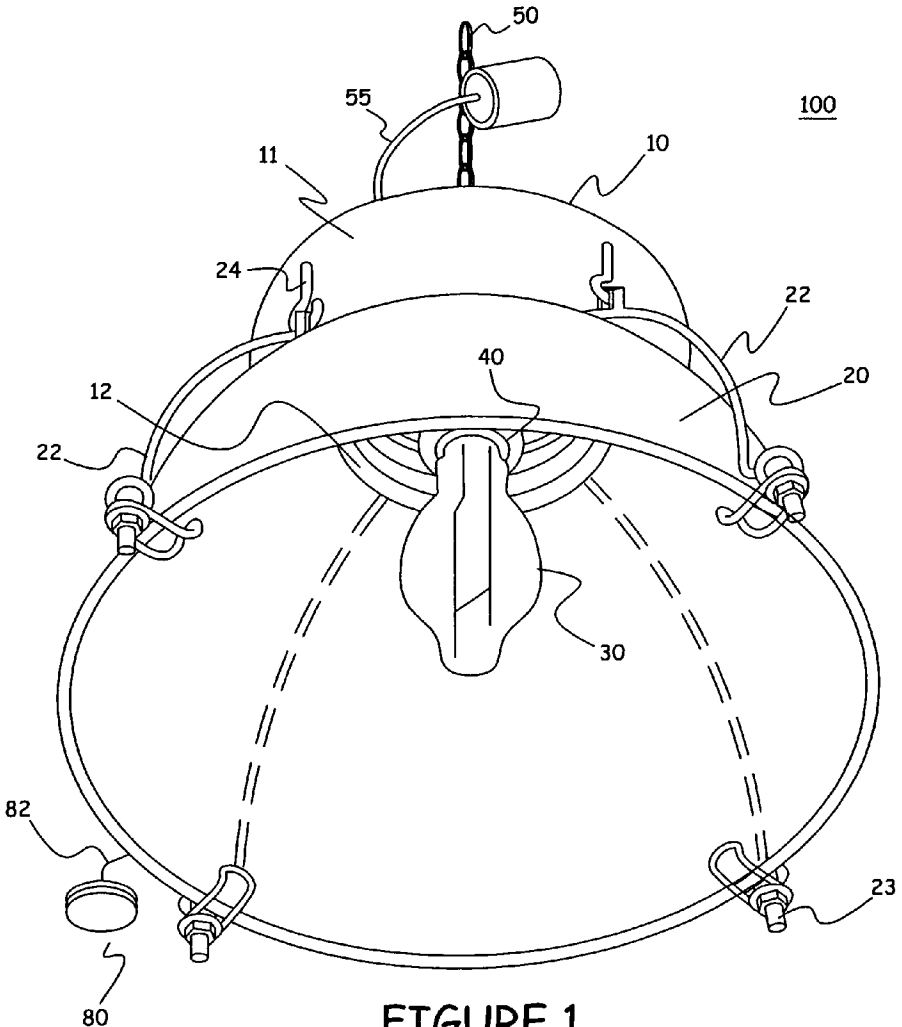
FIG. 1 is a bottom perspective view of a luminaire according to an embodiment of the present subject matter.
Figure 2:
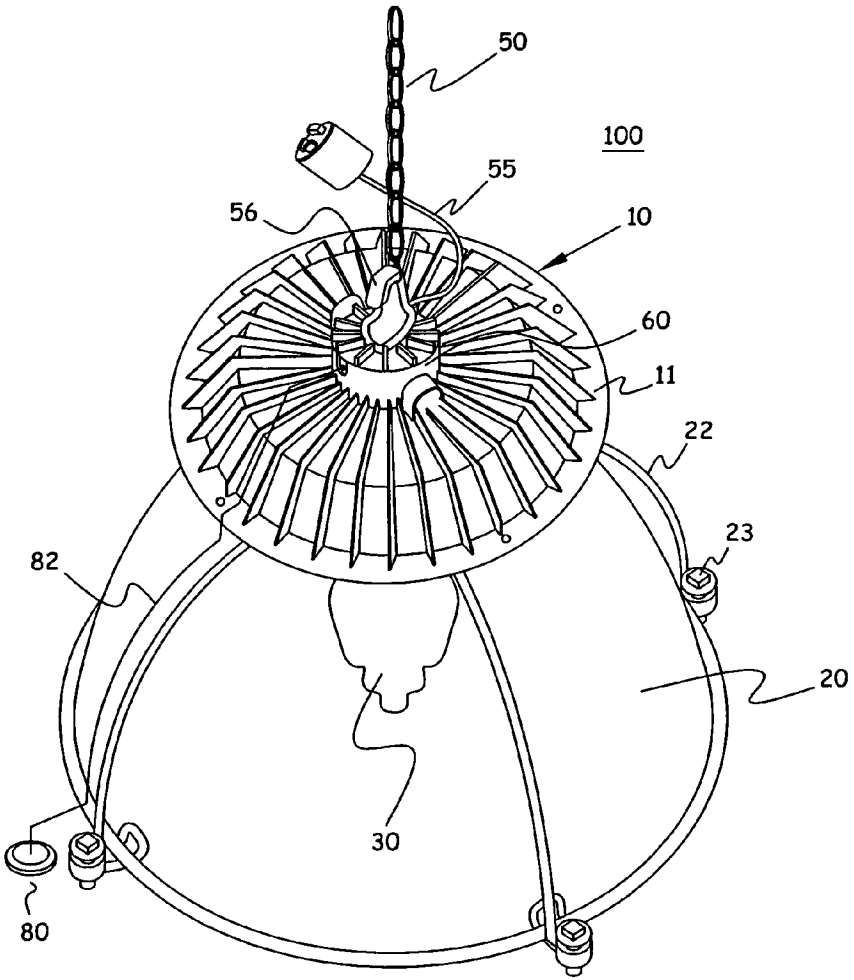
FIG. 2 is a top perspective view of a luminaire according to an embodiment of the present subject matter.
Figure 3:
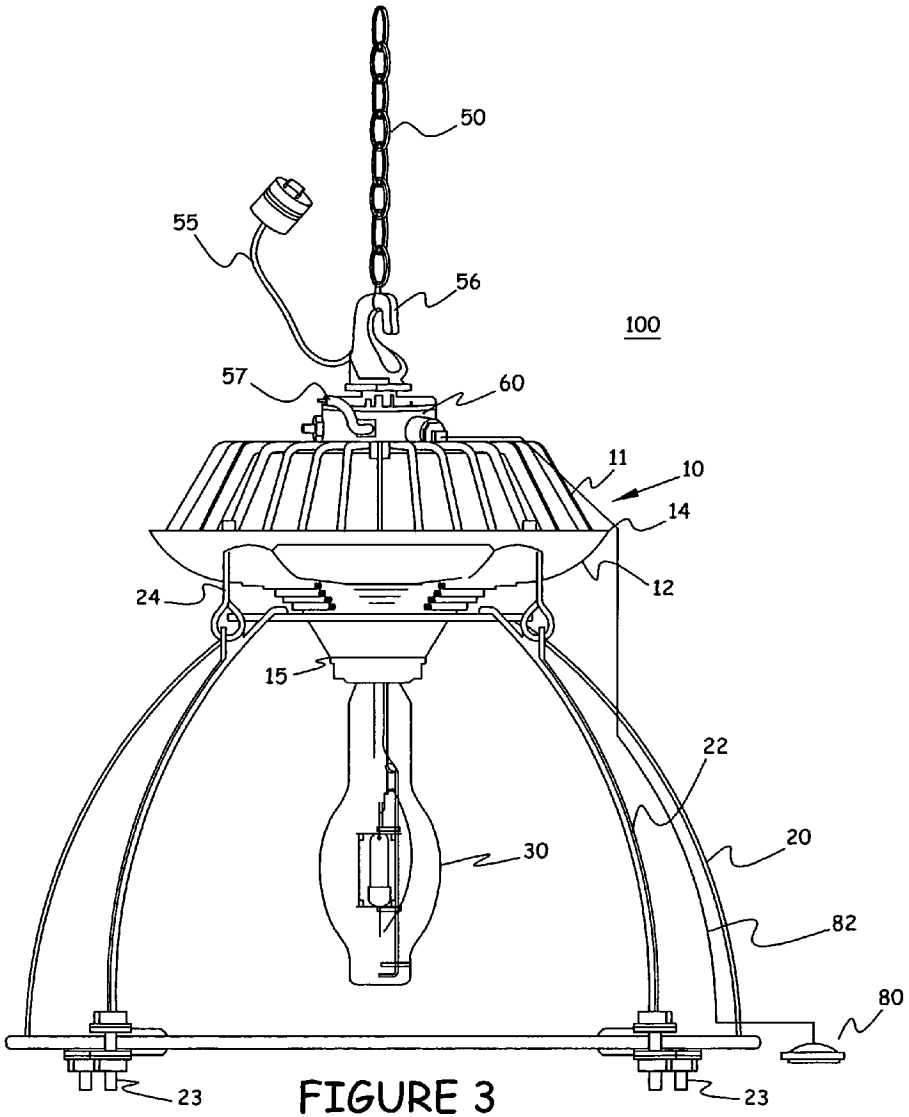
FIG. 3 is a side view of a luminaire according to an embodiment of the present matter.

FIG. 1 is a bottom perspective view of a luminaire according to an embodiment of the present subject matter. FIG. 2 is a top perspective view of a luminaire according to an embodiment of the present subject matter. FIG. 3 is a side view of a luminaire according to an embodiment of the present matter. With reference to FIGS. 1, 2 and 3, the luminaire 100 may include a housing 10 and a reflector 20 supported from the housing 10. The housing may be constructed of cast aluminum or other suitable materials. The housing 10 may include an upper portion 11 and a lower portion 12 mated thereto. The upper and lower portions 11, 12 may form an internal cavity and a central recessed portion adaptable to accept an electrical socket 40. The reflector 20 may be supported from the housing 10 utilizing plural wires or hangers 22 and accompanying securing fasteners 23. One embodiment of the present subject matter may mount the reflector 20 onto the housing 10 by utilizing through-housing threaded rods 24 secured to the housing 10 by fasteners such as bolts and the like. Flexible steel, aluminum or other like material clips may lock the rods 24 in position. It should be noted that the afore-mentioned mount is exemplary only and should by no means limit the scope of the claims appended herewith.

The reflector 20 may be positioned to encompass a light source 30 such as a high intensity discharge ("HID") lamp or other known light source which may be inserted or received in the electrical socket 40. The socket 40 may be electrically connected to an electronics assembly (not shown) positioned within the cavity formed by the upper portion 11 and lower portion 12. The reflector 20 may be positioned in proximity to but spaced apart from the lower portion 12 and downwardly reflect light incident thereon emitted from the light source 30 operating in the socket 40.

The lower portion 12 of the housing 10 may possess a reflective surface covering a major portion of the external surface thereof. The reflective surface may surround the central recessed portion accepting the socket 40 and extend outwardly and upwardly from the central recessed portion toward the periphery of the lower portion 12 such that light incident thereon from the light source 30 may be downwardly reflected. An exemplary shape for the reflective surface may be, but is not limited to, a plurality of concentric non-continuous planar surfaces. The geometry of the lower portion 12 may also be formed such that planes at the widest elevation 14 and narrowest elevation 15 thereof define two parallel cutting planes of a frustum. Exemplary frustums may be, but are not limited to, hyperboloid, ellipsoid, spheroid, cone, and pyramid.

Figure 4:
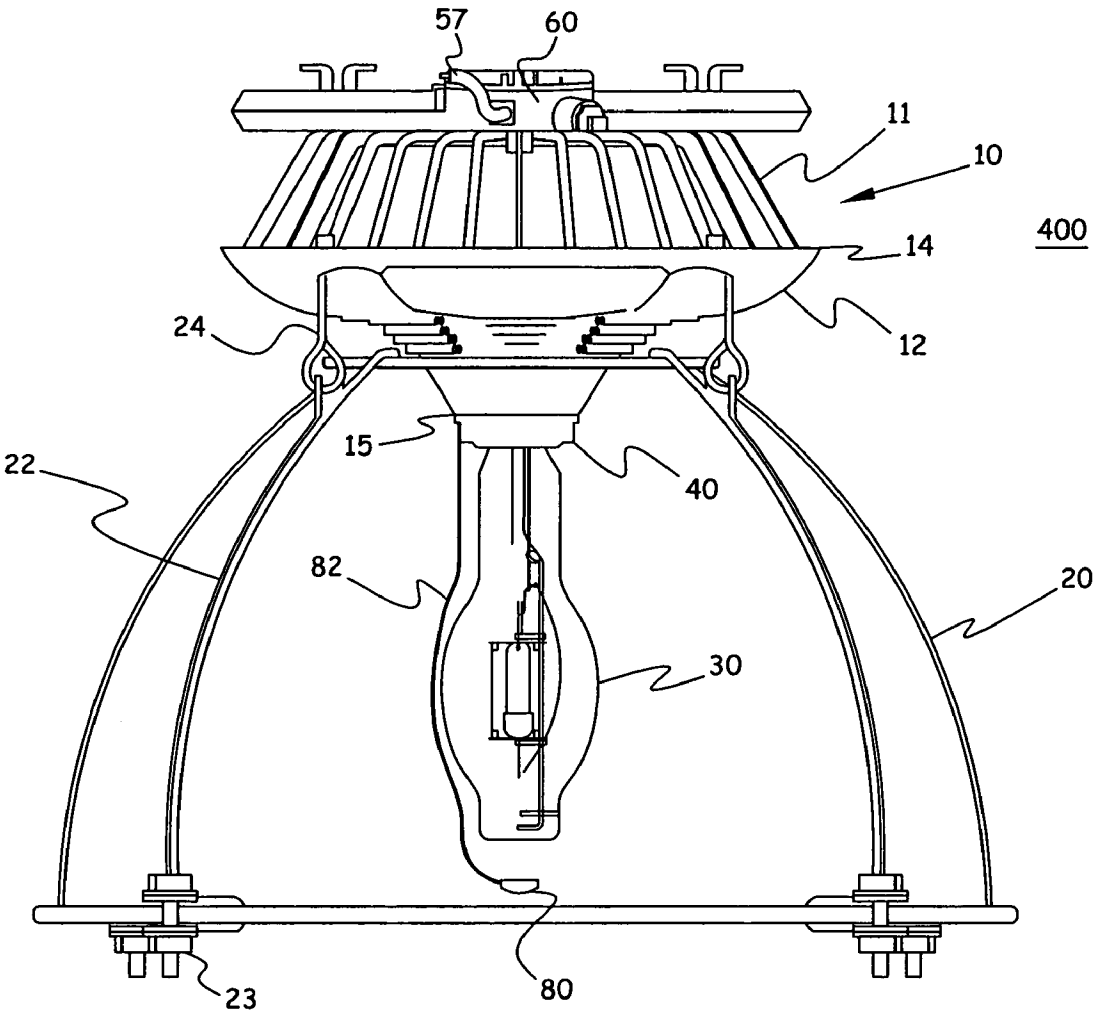
FIG. 4 is a side view of a surface mounted luminaire according to an embodiment of the present subject matter.

The luminaire 100 may be a hanging assembly and extended from a canopy (not shown) or another surface, fixture or rod above the luminaire 100 by a suitable hanging mechanism such as a cable, pendant, or chain 50. Of course, power to the luminaire 100 and the electronics assembly contained within the housing 10 may be supplied via a cable 55 or electrical wire. The chain 50 may be removably attached to a hook 56 which may also be removably attached to a junction box 60. The junction box 60 is generally an extension of the upper section 11 and may permit both cable/chain and surface mounting configurations. One embodiment of the junction box 60 may permit an insertion of switching and communication devices and/or signals into the electronics assembly through segregated chambers. For example, one embodiment of the present subject matter may employ a motion sensor 80, light sensor, or other device such as a photocell. The motion sensor 80 may be removably attached to adjacent hangers 22, fasteners 23, and/or the reflector 20. Signals provided by the motion detector 80 may be sent to components in the electronics assembly via a signal line 82. The signal line 82 may interface with the electronics assembly via the junction box 60 and/or the socket 40. Of course, the motion detector 80 may wirelessly communicate with the electronics assembly and/or may wirelessly communicate with a location remote from the luminaire such as a central processing station. Further, the motion sensor 80 may be positioned at other potions of the luminaire such as, but not limited to, below the light source 30 as depicted in FIG. 4. In one embodiment of the present subject matter, the motion sensor 80 may be powered by low voltage power generated by a component in the electronics assembly 17 such as a ballast. In such an embodiment, the line connecting the ballast and motion sensor 80 may carry both power and communication signals.

A further embodiment of the junction box 60 may be partitioned to allow independent chambers for line voltage and low voltage components, and corresponding holes in the junction box 60 may permit feeding of the corresponding power lines 55 and communication lines 57. While the luminaire 100 is illustrated as a hanging assembly, it is envisioned that other embodiments of luminaires according to the present subject matter may be surface mounted as depicted in FIG. 4. With reference to FIG. 4, a surface mounted luminaire 400 is illustrated where the upper portion 11 of the housing 10 may be mounted directed to an adjacent ceiling, rod, wall or other fixture. Thus, embodiments of the present subject matter may easily be employed in vertical, horizontal, and/or varying angular positions to suit the requirements of an optical or lighting network.

Figure 5:
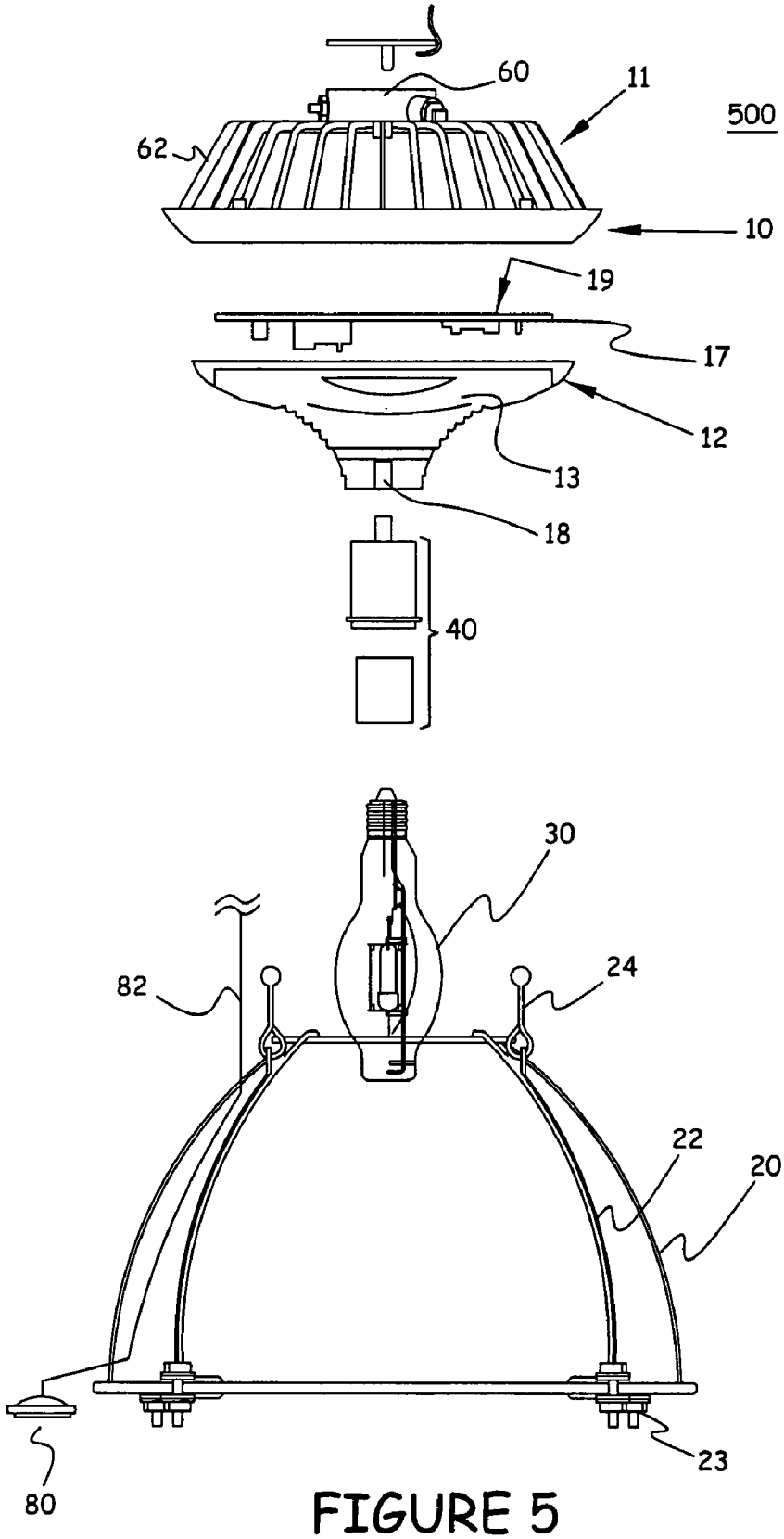
FIG. 5 is an exploded view of a luminaire according to an embodiment of the present subject matter.
Figure 6:
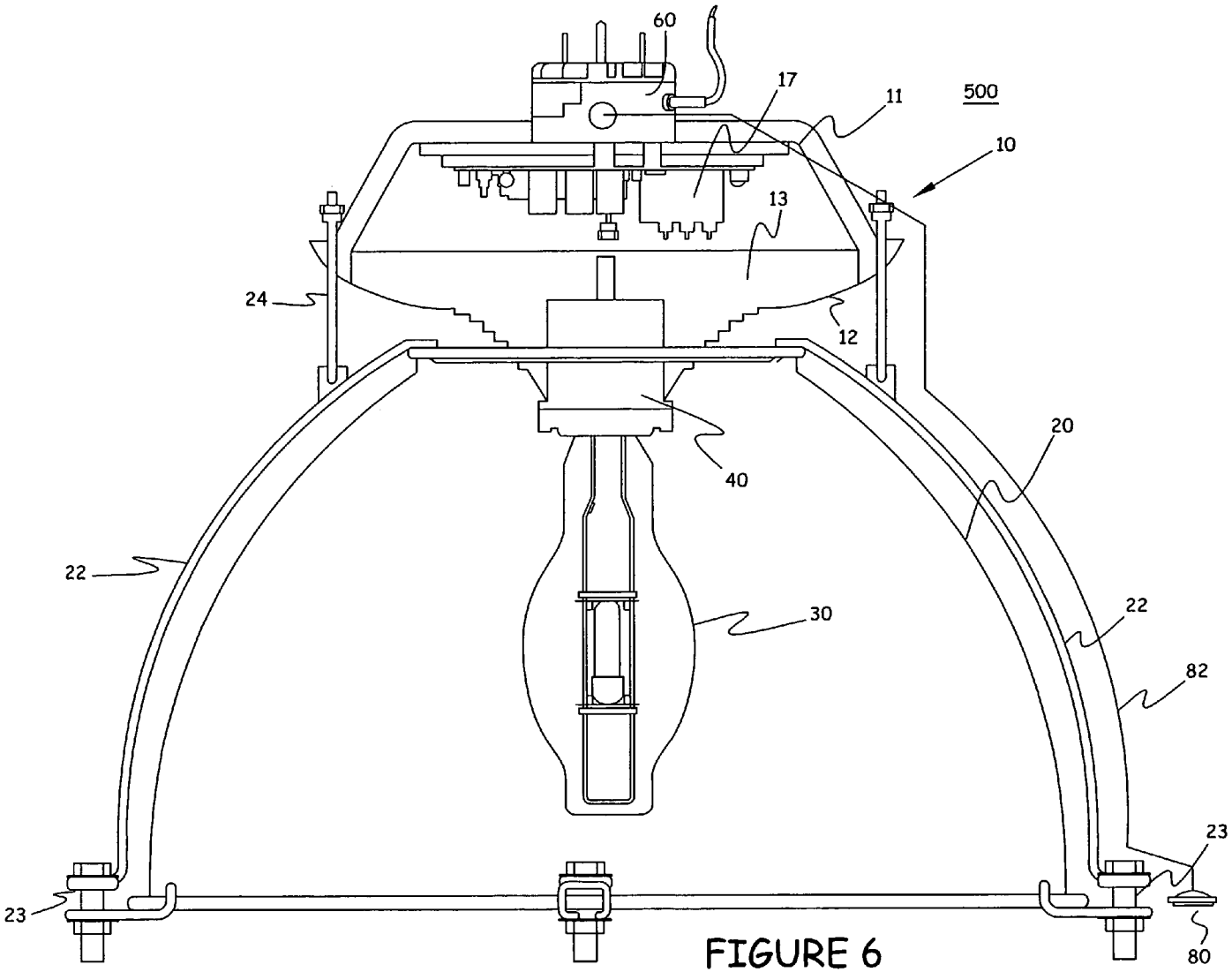
FIG. 6 is a cross section of the luminaire of FIG. 5.

FIG. 5 is an exploded view of a luminaire according to an embodiment of the present subject matter. FIG. 6 is a cross section of the luminaire of FIG. 5. With reference to FIGS. 5 and 6, the luminaire 500 includes a housing 10 comprising an upper portion 11 and lower portion 12. The upper and lower portions form an internal cavity accepting an electronics assembly 17. The electronics assembly 17 may include a ballast board, ballast, capacitor and other lighting and control components, such as, but not limited to relays, switches and the like. The lower portion 12 of the housing 10 may provide insulation 13 therein positioned intermediate the electronics assembly 17 and the socket 40. The insulation 13 may be any common insulating or potting material. The positioning of the insulation 13 forms a thermal break by preventing heat from the light source 30 and socket 40 from rising up into the space surrounding the electronics assembly 17. Through isolation of the light source 30 and socket 40 from the ballast, the temperature rating of the ballast may be increased. The central recessed portion 18 may be adaptable to accept an electrical socket 40. The reflector 20 may be supported from the housing 10 utilizing plural wires or hangers 22, accompanying securing fasteners 23, and/or rods 24. When assembled, the reflector 20 may be positioned to encompass the light source 30 received by the socket 40.

An additional embodiment of the present subject matter may provide a thermal sink 19 located at an upper portion of the electronics assembly 17. For example, the electronics assembly 17 may be mounted on the thermal sink 19. An exemplary thermal sink 19 may be constructed of cast aluminum or other suitable material adaptable to wick heat from the electronics assembly 17. Potting material may also be utilized as a medium to induce uniform heat dissipation between the electronics assembly 17 and the thermal sink 19. Plural heat fins 62 on the upper portion 11 may also be provided to increase the surface area of the housing 10 and carry heat generated by components on the electronics assembly 17 to the housing perimeter.

Another embodiment of the present subject matter may also include an electronics assembly 17 having a programmable microprocessor. The microprocessor may provide the luminaire with communications capabilities with a remote controller from a building or person or a local controller connected to the luminaire. One exemplary local controller may be, but is not limited to, a motion sensor 80, light sensor and/or photocell. An electronics assembly 17 having a microprocessor may enable a luminaire or network of luminaires to respond to building lighting operational schedules, activities, and/or events. Additionally, the microprocessor may provide information in the form of raw data or reports relating to the performance of the luminaire. Such information may be any one or combination of several performance criteria such as, but not limited to, the number of ignitions, duration of any one ignition cycle, dimming range daily and annually, lamp condition and/or failures, ballast power input monitoring, and derivatives thereof. Such information may also be utilized to confirm engineering projections for rebate claims and power usage monitoring. Reporting and controlling may occur remotely or locally and may occur by wireless or hardwire signals. Further, the information may be periodically transmitted or continuously transmitted to a remote or local controller. In another embodiment of the present subject matter, information may be transmitted to a remote controller upon the occurrence of an even such as, but not limited to, a request transmitted by a remote controller and received by the luminaire or the failure of a component in the luminaire.

In another embodiment of the present subject matter, the motion sensor 80 may possess directional aiming and programming capabilities allowing the light output of the luminaire to react to the requirements of an optical network or specific lighting area. For example, microprocessors in the electronics assembly 17 may adjust light levels according to signals provided from the sensor 80 or from a remote and/or local controller. By way of further example, a luminaire may be operated by a pre-programmed schedule and during an "on" period, the motion sensor 80 and/or photocell may govern operation of the luminaire(s) including dimming and turning the associated luminaire(s) on and off. Exemplary microprocessors may be factory pre-programmed and/or may be programmed from a remote controller.

Figure 7:
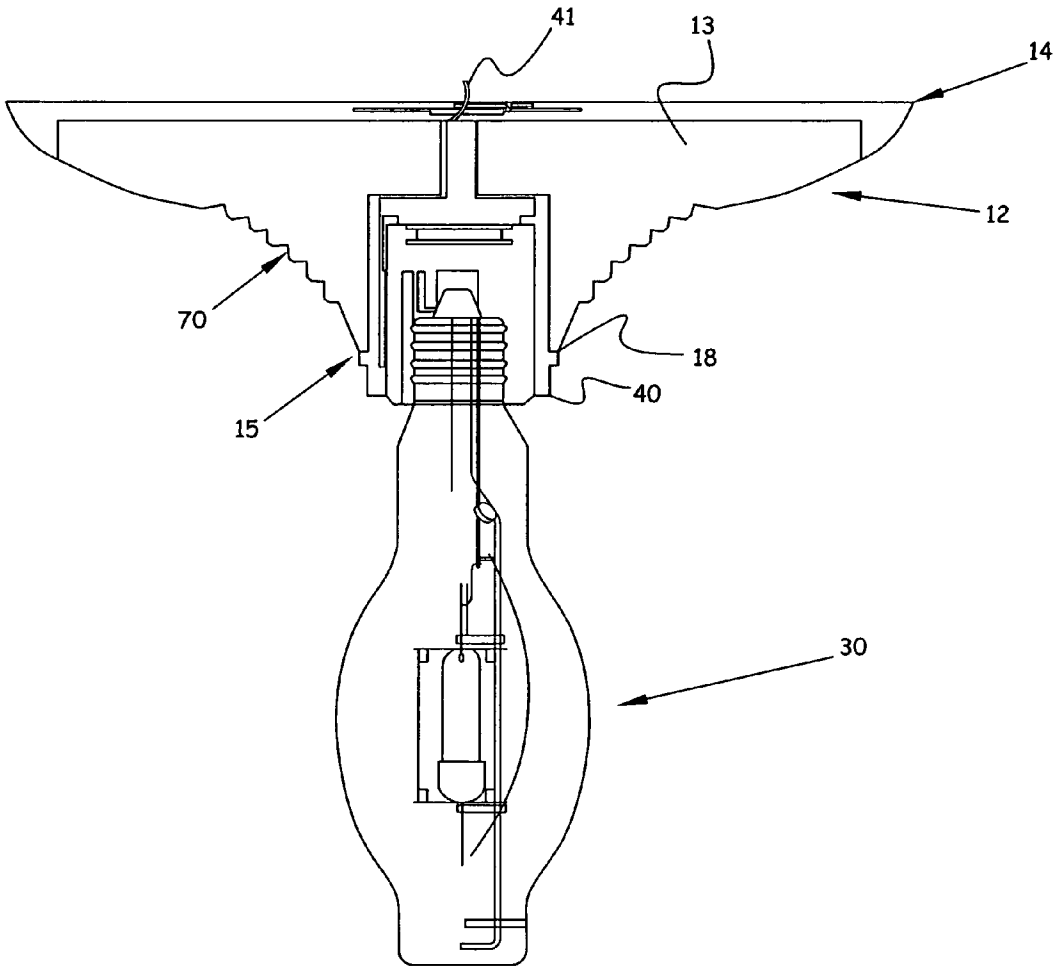
FIG. 7 is a cross sectional view of a lower portion of a housing according to an embodiment of the present subject matter.
Figure 8A:
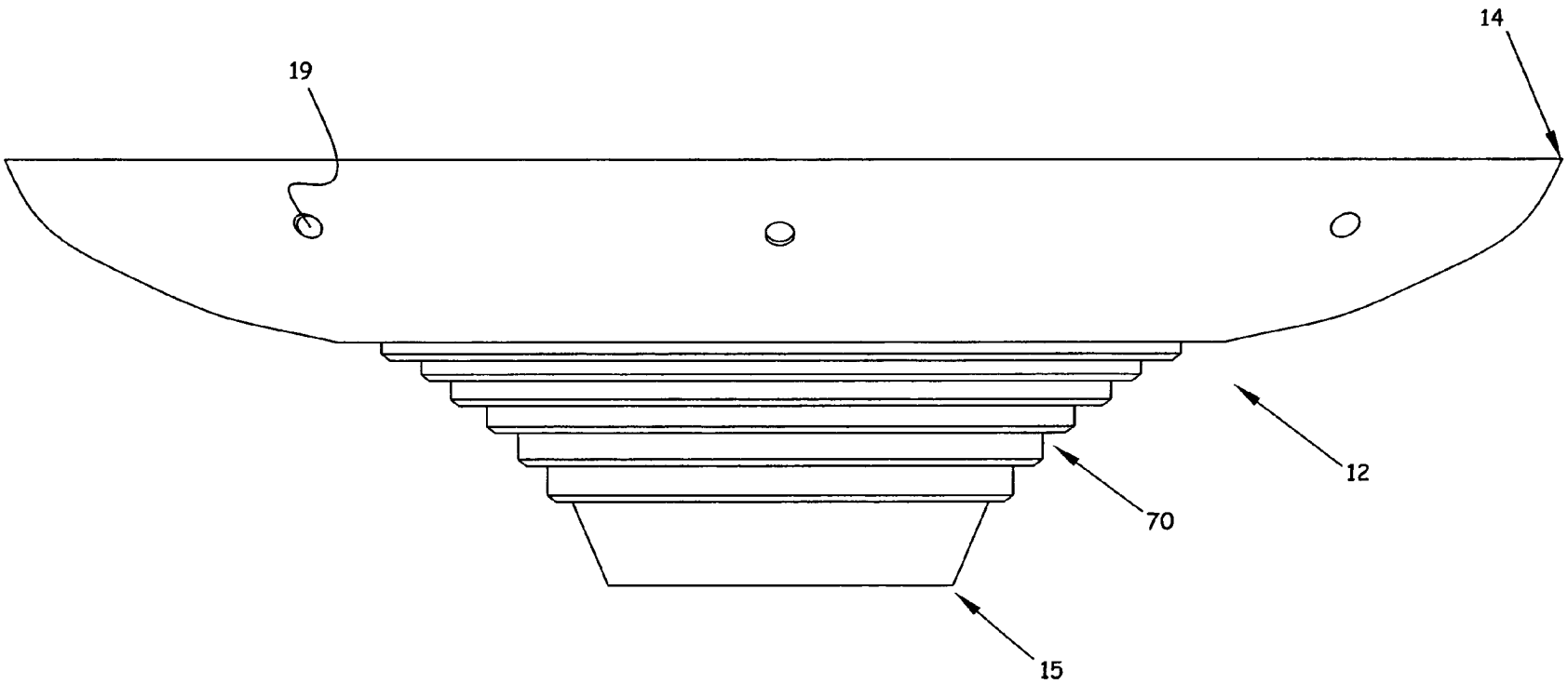
FIG. 8A is a side view of a lower portion of a housing according to an embodiment of the present subject matter.
Figure 8B:
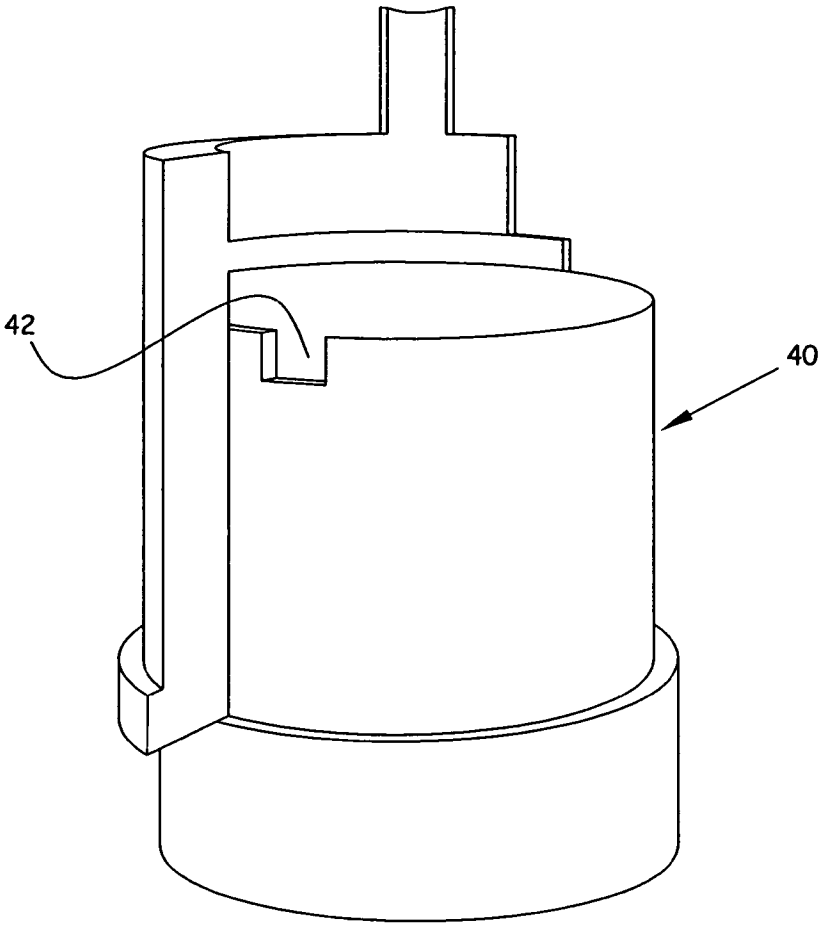
FIG. 8B is a perspective view of a socket according to an embodiment of the present subject matter.

FIG. 7 is a cross sectional view of a lower portion of a housing according to an embodiment of the present subject matter. FIG. 8A is a side view of a lower portion of a housing according to an embodiment of the present subject matter. FIG. 8B is a perspective view of a socket according to an embodiment of the present subject matter. With reference to FIGS. 7 and 8A, the lower portion 12 of the housing 10 may possess a reflective surface covering a major portion of the external surface thereof. The reflective surface may surround the central recessed portion 18 accepting the socket 40 and extend outwardly and upwardly from the central recessed portion 18 toward the periphery of the lower portion 12 such that light incident thereon from the light source 30 may be downwardly reflected. An exemplary shape for the reflective surface may be, but is not limited to, a plurality of concentric non-continuous planar surfaces 70. The geometry of the lower portion 12 may also be formed such that planes at the widest elevation 14 and narrowest elevation 15 thereof define two parallel cutting planes of a frustum. Exemplary frustums may be, but are not limited to, hyperboloid, ellipsoid, spheroid, cone, and pyramid. The socket 40 may be electrically connected via a wire 41 or other means to the electronics assembly 17 (not shown) positioned within the cavity formed by the upper portion 11 and lower portion 12. The lower portion 12 may be removably attached to the upper portion 11 by fasteners, rods or other securing mechanisms (not shown) through suitable holes 19 therein. With reference to FIG. 8B, one embodiment of a socket 40 is illustrated as adjustable along a central longitudinal axis. For example, the socket 40 may be adjusted by a rotational movement about the longitudinal axis and/or an axial movement along the longitudinal axis to engage pre-determined set-points. These set-points may be in the form of detents 42 in the socket 40 which permit varying optical distributions of the corresponding light source 30. It should be noted that the aforementioned example of a socket should not be construed to limit the scope of the claimed appended herewith.

Figure 9:
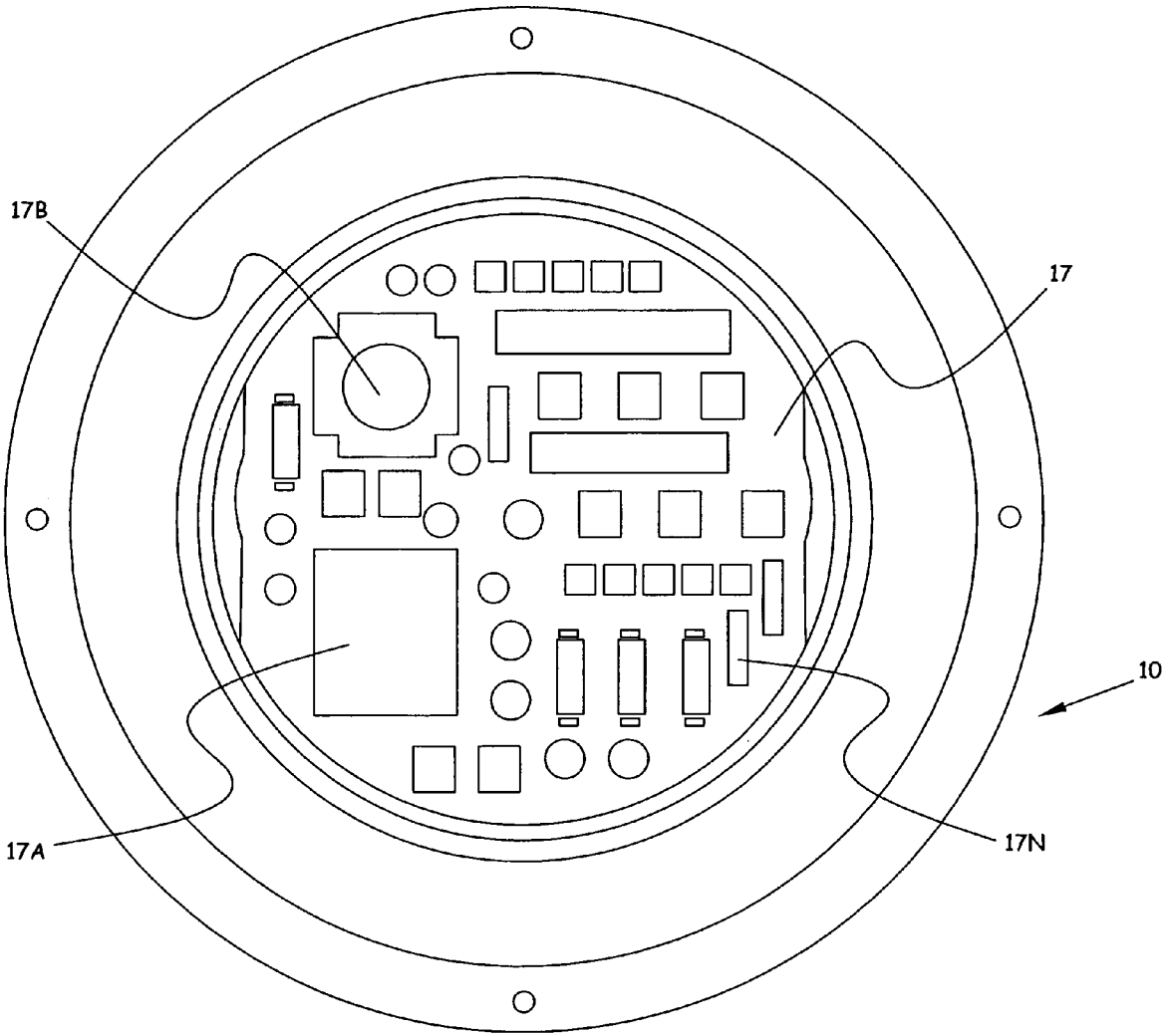
FIG. 9 is a plan view of an electronics assembly according to an embodiment of the present subject matter.

FIG. 9 is a plan view of an electronics assembly according to an embodiment of the present subject matter. With reference to FIG. 9, an electronics assembly 17 may generally comprise a rectangular, square or circular board inscribed to fit the circular footprint of the housing 10 to maximize the surface area of the board. Components 17A, 17B . . . 17N may be appropriately placed on the board to account for uniform heat dissipation. Through-holes may be provided in the board to permit the insertion of power and communication wires. Use of conventional electronic ballasts may also be compatible by placing the ballast on a circular metallic disk above reflected potting or insulative materials. Potting materials between the ballast and the disk may act as a medium to transfer heat from the ballast through the disk to the housing perimeter.

Figure 10:
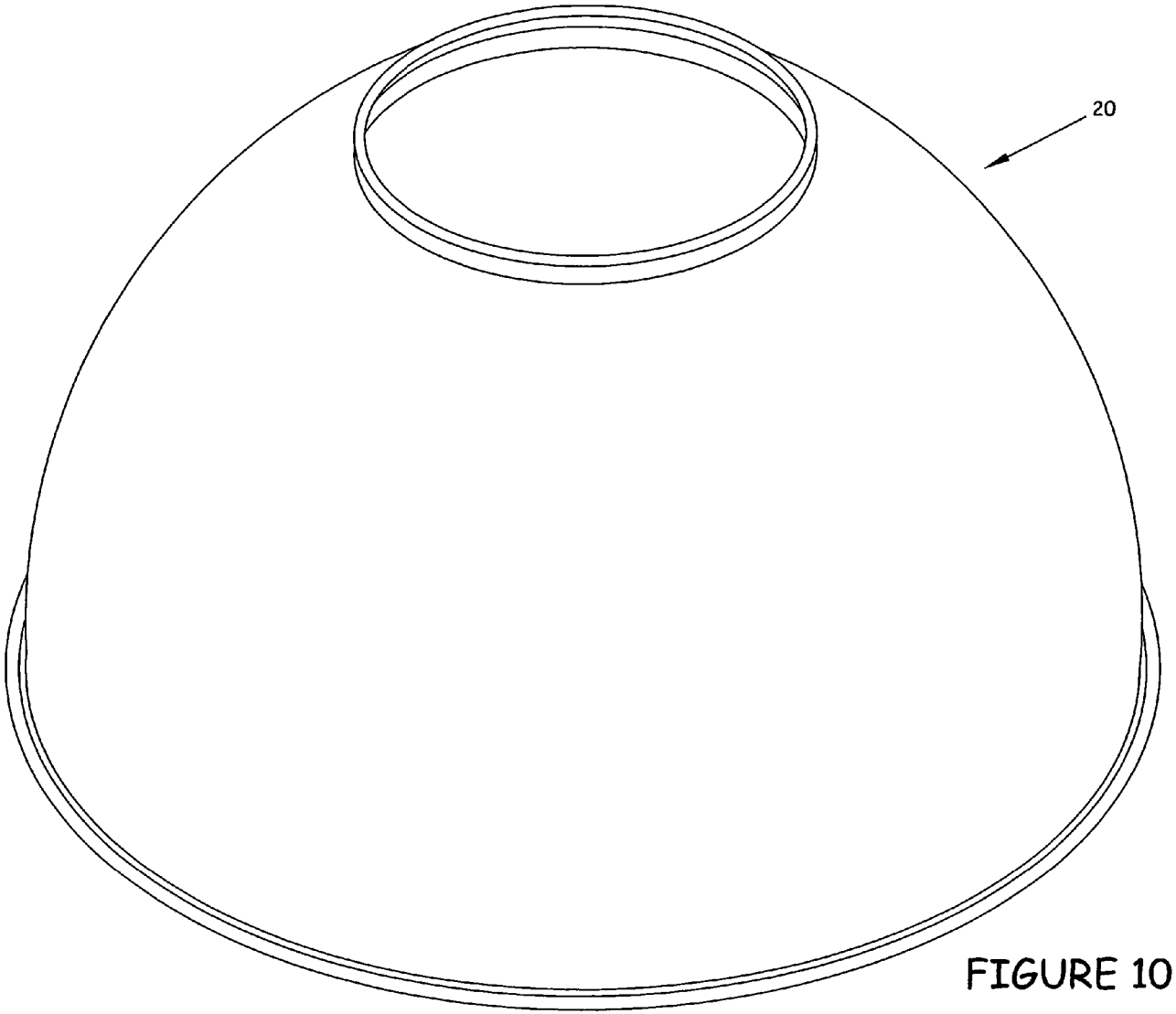
FIG. 10 is a perspective view of a reflector according to an embodiment of the present subject matter.

FIG. 10 is a perspective view of a reflector according to an embodiment of the present subject matter. With reference to FIG. 10, a reflector 20 may be constructed of highly reflective light-gauge metallic or other suitable material. It is contemplated that the reflector 20 may also be any coated or uncoated glass, plastic or metallic material typical of those utilized in the art for distributing light. Multiple concentric micro-reflectors may be staggered above one another on the surfaces of the reflector 20 including those surfaces facing the light source 30. The micro-reflectors may be designed to capture light beams and redirect the beams in a pre-calculated and/or uniform fashion. The reflector 20 may also deflect a portion of the infrared heat generated by the light source 30 away from the lower portion 12 of the housing 10. The reflector 20 may be provided with a hemispheroidal, conical or other suitable geometry for directing light at angles of varying degrees according to a desired lighting pattern. Surfaces of the reflector 20 including the surface facing the light source 30 may comprise one or plural coatings of vaporized and/or spattered metallic particles or materials to increase reflectance values while permitting some distribution of light to illuminate adjacent structures such as a ceiling. Other exemplary materials may be, but are not limited to, polymeric prismatic materials.

Figure 11A:
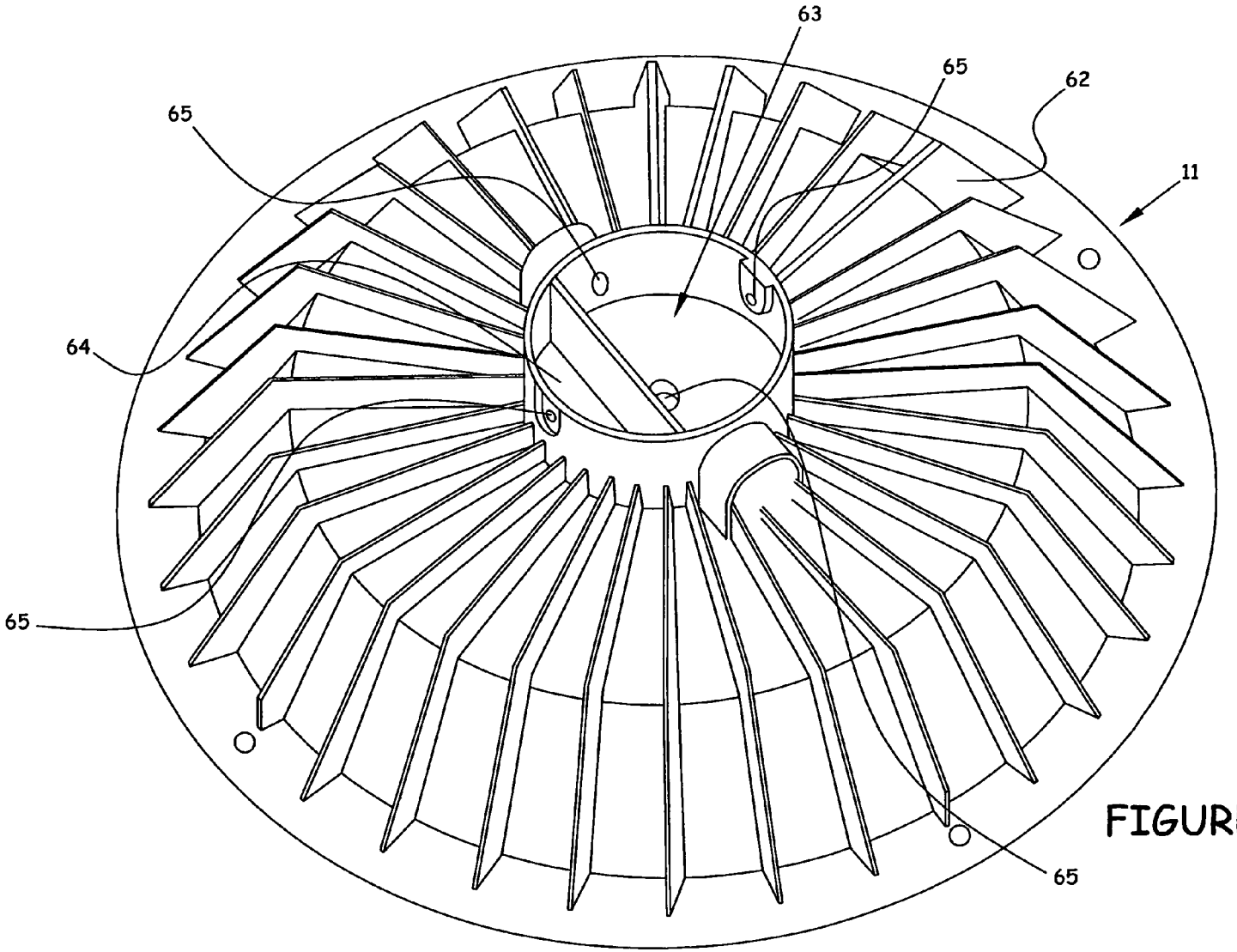
FIG. 11A is a perspective view of an upper portion of a housing according to an embodiment of the present subject matter.
Figure 11B:
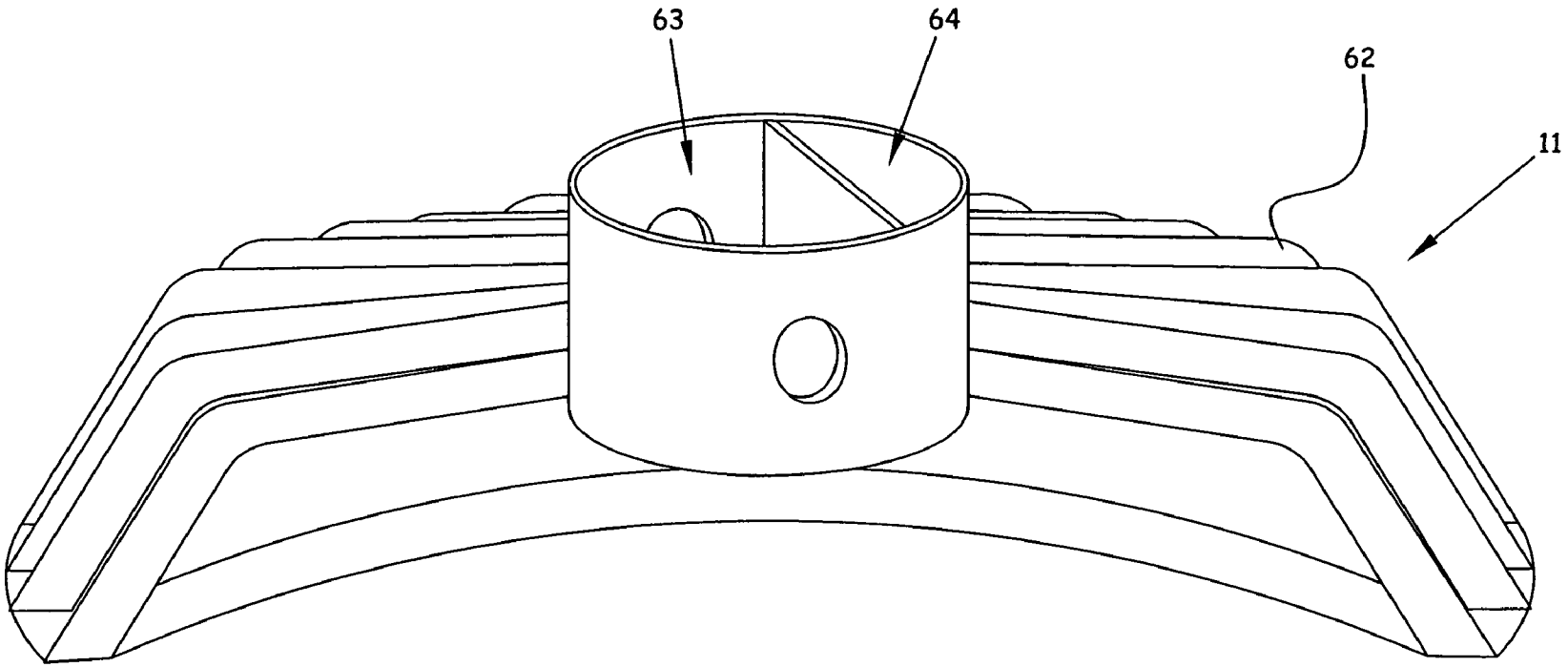
FIG. 11B is a cross section of an upper portion of a housing according to an embodiment of the present subject matter.
Figure 12:
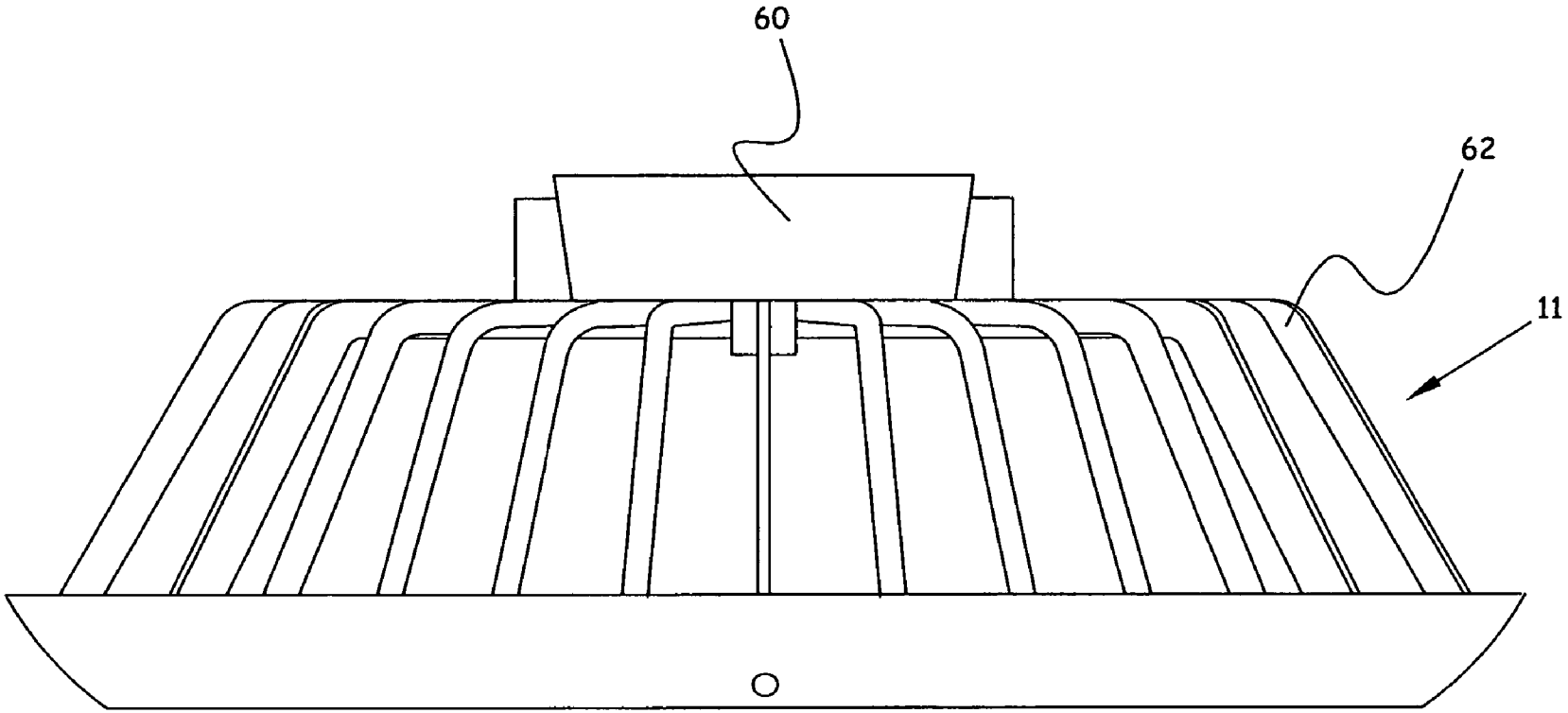
FIG. 12 is a side view of an upper portion of a housing according to an embodiment of the present subject matter.
Figure 13:
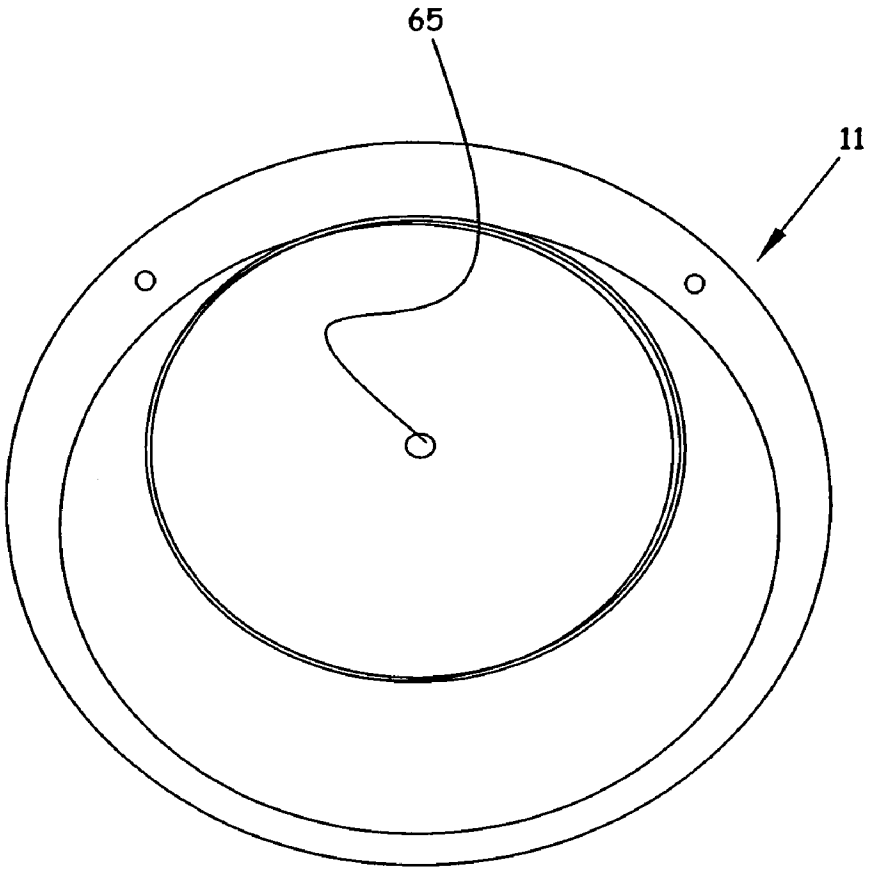
FIG. 13 is a bottom perspective view of an upper portion of a housing according to an embodiment of the present subject matter.

FIG. 11A is a perspective view of an upper portion of a housing according to an embodiment of the present subject matter. FIG. 11B is a cross section of an upper portion of a housing according to an embodiment of the present subject matter. FIG. 12 is a side view of an upper portion of a housing according to an embodiment of the present subject matter. FIG. 13 is a bottom perspective view of an upper portion of a housing according to an embodiment of the present subject matter. With reference to FIGS. 11A, 11B, 12 and 13, the upper portion 11 of the housing 10 may include heat fins 62 to assist in removal of heat from the luminaire and electronics assembly 17 and may include a junction box 60 to provide for the insertion of switching and communication devices and/or signals through selected holes 65 into the electronics assembly 17 via chambers 63, 64. Thus, the junction box 60 may feed power lines and communication lines to the appropriate components on the electronics assembly 17.

Figure 14A:
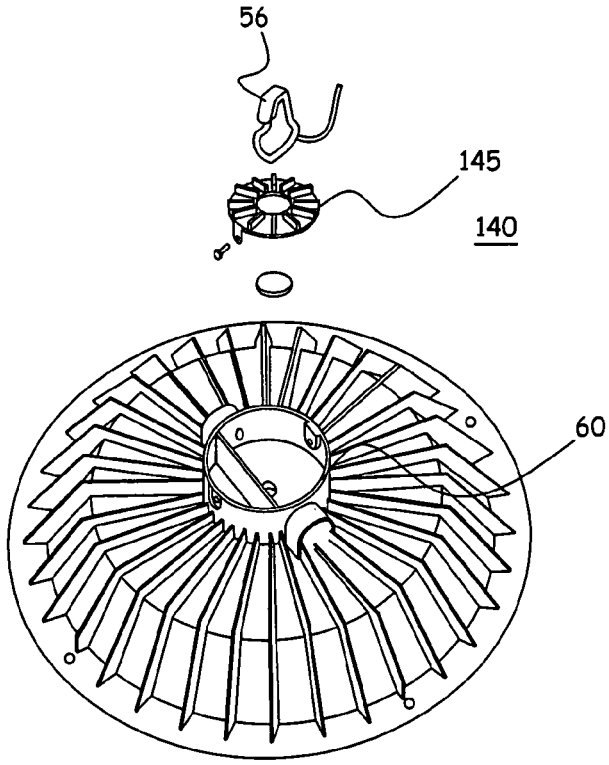
FIGS. 14A and 14B are perspective views of mounting assemblies according to embodiments of the present subject matter.
Figure 14B:
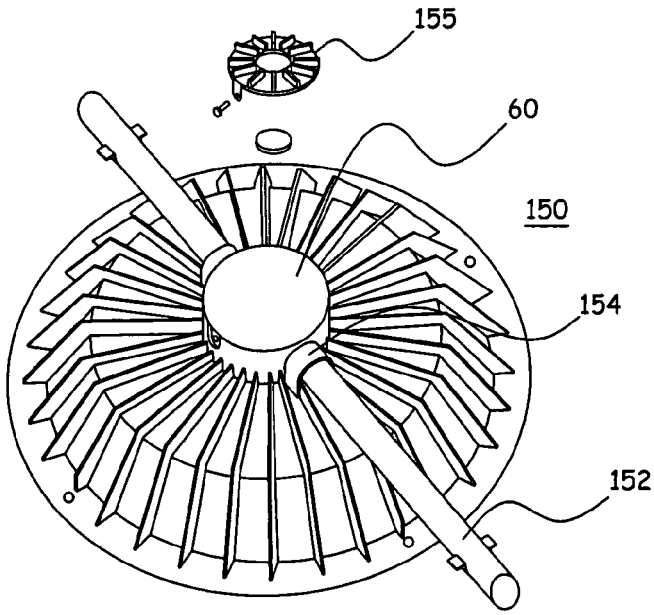

FIGS. 14A and 14B are perspective views of mounting assemblies according to embodiments of the present subject matter. With reference to FIG. 14A, a hanging mounting assembly 140 is illustrated for mounting a luminaire to a suitable hanging mechanism such as a cable, pendant, or chain. The mounting assembly 140 may provide a suitable hook 56 and mounting bracket 145 that interfaces with and removably attaches to the junction box 60. With reference to FIG. 14B, a surface mounting assembly 150 is illustrated for mounting a luminaire to an adjacent structure such as, but not limited to, a ceiling, wall, rod or other fixture. The mounting assembly 150 may provide a mounting rod 152 inserted into the junction box 60 via mounting channels 154 and a mounting bracket 155 for interfacing with the junction box 60 and mounting rod 152. The mounting rod 152 may then be affixed to the desired adjacent structure.

Figure 15:
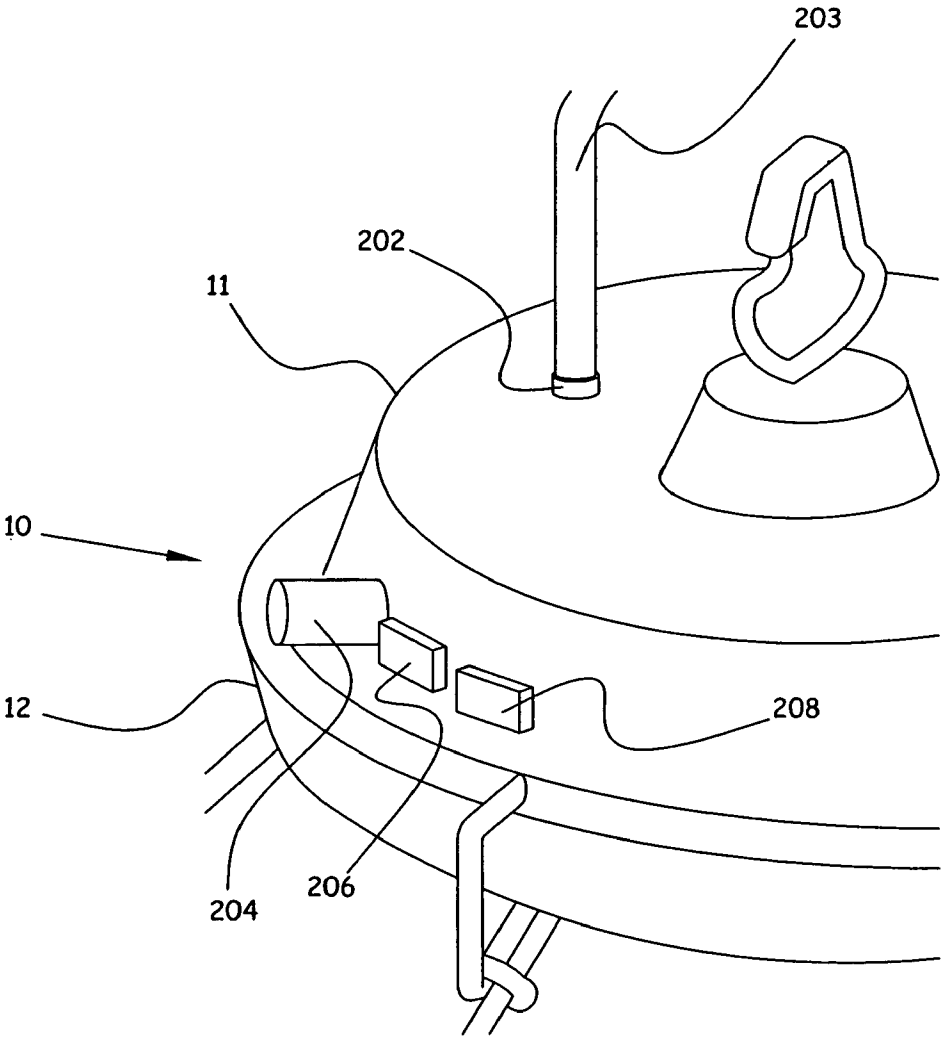
FIG. 15 is a perspective view of switching and input mechanisms according to an embodiment of the present subject matter.

FIG. 15 is a perspective view of switching and input mechanisms according to an embodiment of the present subject matter. With reference to FIG. 15, the upper portion 11 of the housing 10 is illustrated having a plurality of switches and ports. A network port 202 may be provided on an outer surface of the upper portion 11 to provide entry of a network cable 203 into the cavity formed by the upper and lower portions of the housing 10. The network cable 203 may be operatively connected to appropriate components on the electronics assembly 17 for the receipt and transmission of communication signals. The outer surface may also provide a radio frequency ("RF") transmitting and/or receiving port 204 for transmitting/receiving RF signals and providing the respective signals to/from the appropriate components on the electronics assembly 17. Signals from remote controllers such as a building central controller and/or local controllers such a motion sensor or photocell may be transmitted to and received by the electronics assembly and associated microprocessors via the network cable 203, RF port 204, and/or power line. Signals from the electronics assembly may be similarly transmitted to the remote controllers and/or local controllers via the network cable 203, RF port 204, and/or power line. Other embodiments of the present subject matter may also provide switching devices such as a voltage selection switch 206 and/or an on/off switch 208.

Figure 16:
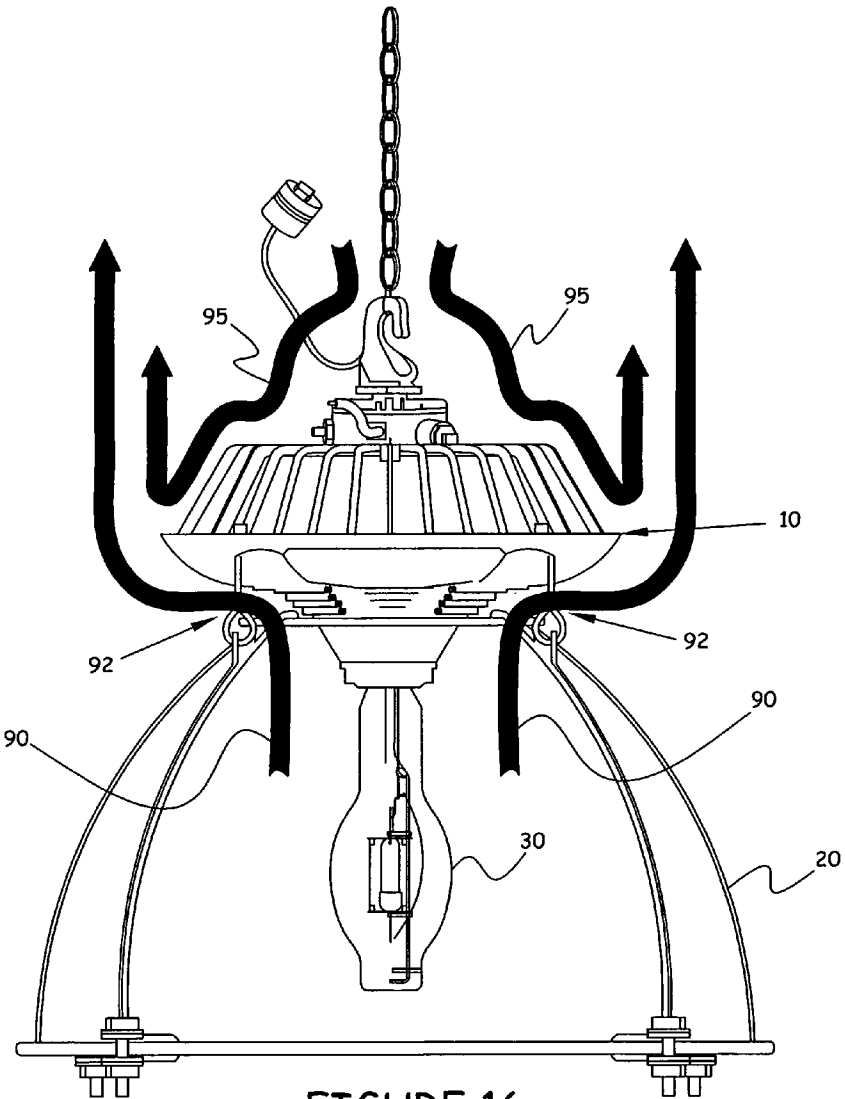
FIG. 16 is a side view of a luminaire according to one embodiment of the present subject matter.
Figure 17:
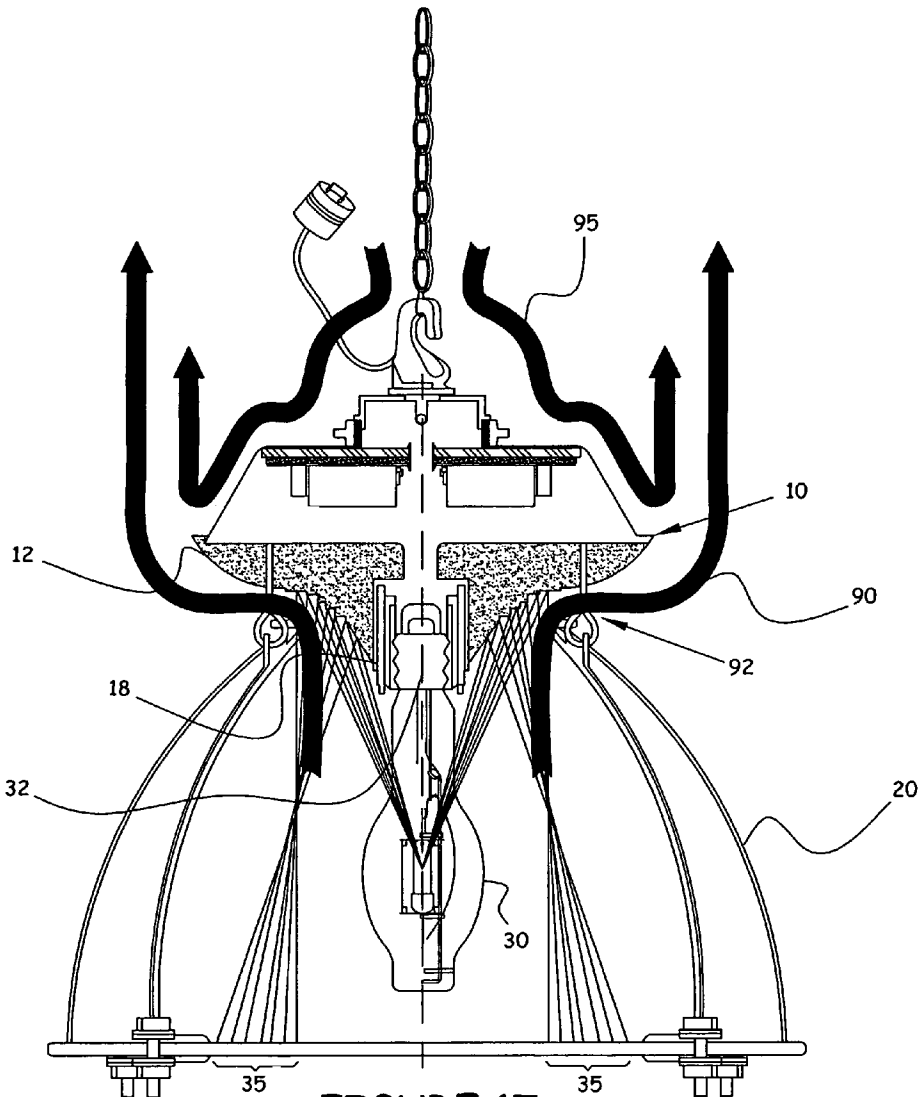
FIG. 17 is a cross sectional view of a luminaire according to another embodiment of the present subject matter.
Figure 18:
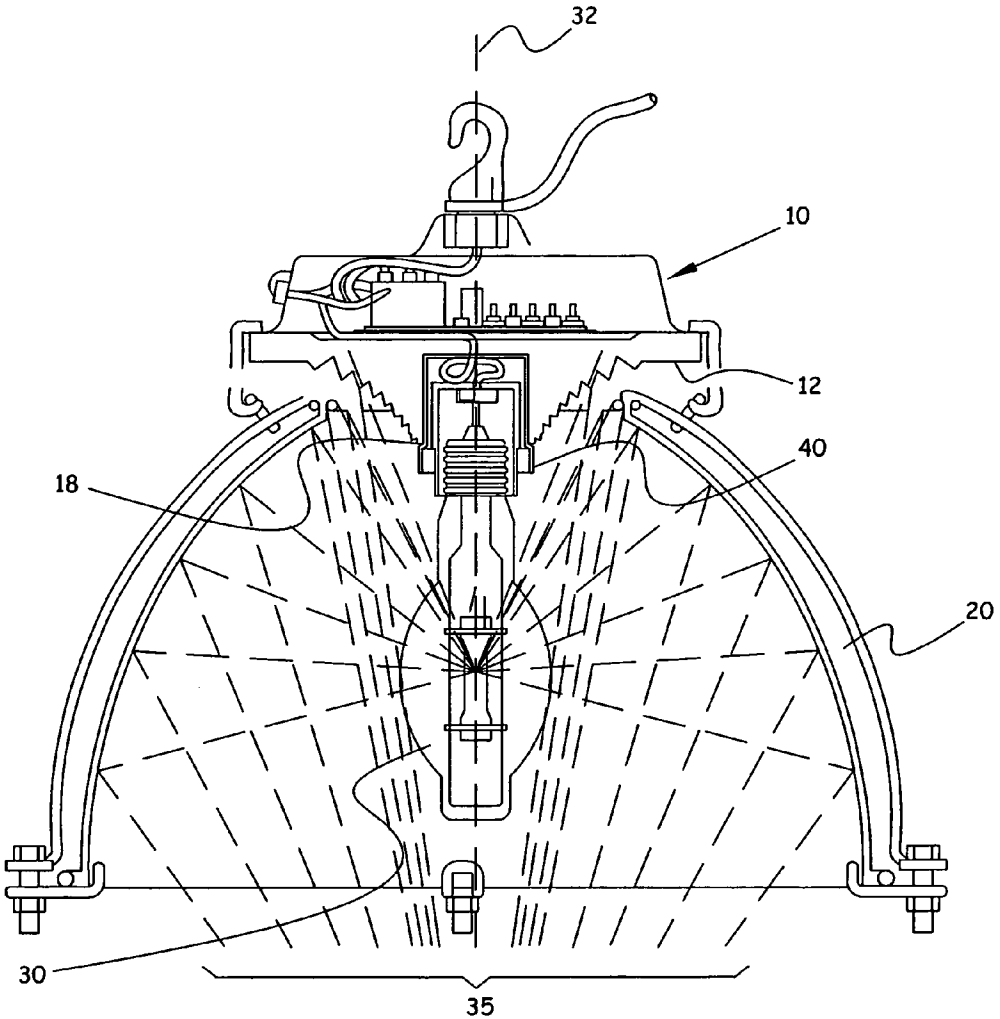
FIG. 18 is a cross sectional view of a luminaire according to a further embodiment of the present subject matter.

FIG. 16 is a side view of a luminaire according to one embodiment of the present subject matter. FIGS. 17 and 18 are a cross sectional views of luminaires according to embodiments of the present subject matter. With reference to FIGS. 16, 17 and 18, the positioning of the reflector 20, the housing 10, and/or the light source 30 provides for efficient airflow management, heat transfer and optical distribution. For example, the geometry of the reflector 20 and the upward and outward geometry of the lower portion 12 of the housing convectively induces hot air surrounding the light source 30 to flow upward 90 and exit through the gap 92 between the housing 10 and the reflector 20. The gap 92 may be annular or any other suitable geometry. In one embodiment of the present subject matter, the concentric flow 90 of hot air generates an opposite cooler air downdraft 95 onto the housing 10 to assist in reducing the electronic assembly 17 and ballast temperatures and effectuating a convective uniform airflow upward and outward away from the electronics assembly 17 during operation of the light source 30. As a result of the air flow induced by embodiments of the present subject matter, the internal components of the housing 10 may be efficiently and convectively cooled and the respective ballast life extended.

With reference to FIGS. 17 and 18, the positioning of the reflector 20 and/or the light source 30 along a longitudinal axis 32 in relation to the housing 10 and the lower portion 12 thereof may be such that a desired lighting pattern is formed. For example, multiple concentric micro-reflectors on the surface of the reflector may capture light beams from the light source 30 and redirect the beams in a pre-calculated and/or uniform fashion or pattern; however, such an example should not in any way limit the scope of the claims appended herewith. The reflective surface of the lower portion 12 of the housing 10 extending outwardly and upwardly from the central recessed portion 18 toward the periphery of the lower portion 12 may also redirect light incident thereon from the light source 30 in conjunction with the redirection of the light from the reflector 20. Optical distribution patterns 35 in additional embodiments of the present subject matter may also be adjusted by selectively moving the position of the socket 40 relative to the reflector 20 along the longitudinal axis 32.

It is thus an aspect of embodiments of the present subject matter to increase luminaire lighting efficiency and operational versatility while prolonging the respective life expectancy of the ballast.

As shown by the various configurations and embodiments illustrated in FIGS. 1-18, a method and apparatus for a ballast housing for an electronic HID luminaire have been described.

While preferred embodiments of the present subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A luminaire for a light source comprising:

a housing comprising:

an upper portion;

a lower portion mated to said upper portion forming an internal cavity; and a central recessed portion formed in said lower portion;

an electronics assembly positioned within said cavity, said electronics assembly including a ballast;

a socket positioned within said central recessed portion, said socket being operatively connected to said ballast and being adapted to operatively and removeably receive a light source;

insulation positioned within said cavity intermediate said electronics assembly and said socket;

a reflector supported from said housing, said reflector positioned to encompass a light source operatively received in said socket with the upper end of said reflector positioned in proximity to but spaced from said lower portion, said reflector reflecting downwardly light incident thereon emitted from a light source operating in said socket; and a reflective surface covering at least a major portion of the external surface of said lower portion, said reflective surface surrounding said central recessed portion and extending concavely and convexly from said central recessed portion toward the periphery of said lower portion, said reflective surface having a shape for reflecting downwardly light incident thereon emitted from a light source operating in said socket.

2. The luminaire of claim 1 wherein said reflective surface comprises a plurality of concentric non-continuous planar surfaces.

3. The luminaire of claim 1 wherein said light source is a high intensity discharge lamp.

4. The luminaire of claim 1 wherein the position of said socket is vertically adjustable along a central longitudinal axis.

5. A luminaire for a light source comprising:

a housing assembly defining an internal cavity and having a lower external surface extending concavely and convexly from a central recessed portion formed in a lower portion of said housing assembly toward an upper periphery of said lower portion of said housing assembly;

an electronics assembly positioned within said cavity, said electronics assembly including a ballast;

a lamp socket positioned in said central recessed portion and operatively connected to said electronics assembly, said socket being adapted to operatively and removeably receive a light source therein; and a reflector supported from said housing assembly, said reflector positioned to encompass a light source operatively received in said socket with the upper end of said reflector positioned in proximity to but spaced from said lower external surface, said reflector reflecting downwardly light incident thereon emitted from a light source operating in said socket, wherein said lower portion of said housing assembly further comprises a reflective surface covering at least a major portion of the external surface of said lower portion, said reflective surface having a shape for reflecting downwardly light incident thereon emitted from a light source operating in said socket.

6. The luminaire of claim 5 wherein the planes at the widest and narrowest elevations of said lower portion of said housing assembly define two parallel cutting planes of a frustum.

7. The luminaire of claim 5 wherein said light source is a high intensity discharge lamp.

8. The luminaire of claim 5 wherein said reflective surface comprises a plurality of concentric non-continuous planar surfaces.

9. The luminaire of claim 5 further comprising insulation positioned within said cavity intermediate said electronics assembly and said socket.

10. The luminaire of claim 5 wherein said electronics assembly further comprises a microprocessor adaptable to wirelessly report the performance of the luminaire.

11. The luminaire of claim 5 wherein the position of said socket is vertically adjustable along a central axis of said central recessed portion.

12. The luminaire of claim 5 wherein said electronics assembly further comprises a programmable microprocessor adaptable to communicate with a controller.

13. The luminaire of claim 12 wherein the controller is a motion sensor.

14. The luminaire of claim 13 wherein the motion sensor is attached to said luminaire.

15. The luminaire of claim 12 wherein the controller is a remote building controller.

16. The luminaire of claim 12 wherein communication with the controller is wireless.

17. The luminaire of claim 12 wherein said microprocessor wirelessly reports the performance of the luminaire as a function of information selected from the group consisting of: number of lamp ignitions, duration of any one ignition cycle, dimming range daily, dimming range annually, lamp condition, lamp failures, and ballast power.

18. The luminaire of claim 17 wherein said information is periodically transmitted to a remote database.

19. The luminaire of claim 17 wherein said information is continuously transmitted to a remote database.

20. The luminaire of claim 17 wherein said information is transmitted to a remote database upon the occurrence of an event.

21. The luminaire of claim 20 wherein said event is a request for predetermined information transmitted from a remote location and received by the luminaire.

22. The luminaire of claim 20 wherein said event is the failure of a component in the luminaire.

* * * * *